US008070024B2

(12) United States Patent
Durant et al.

(10) Patent No.: US 8,070,024 B2
(45) Date of Patent: Dec. 6, 2011

(54) DISPENSING NOZZLE COMPRISING AN AXIALLY ATTACHED CLOSURE SLEEVE

(75) Inventors: Jacques Durant, Mellecey (FR); Christophe Roy, Dieppe (FR); Matthieu Vasseur, Varengeville-sur-Mer (FR); Philippe Duby, Pont de Vaux (FR)

(73) Assignee: Rexam Dispensing Systems S.A.S. (FR)

( * ) Notice: Subject to any disclaimer, the term of this patent is extended or adjusted under 35 U.S.C. 154(b) by 769 days.

(21) Appl. No.: 12/055,575

(22) Filed: Mar. 26, 2008

(65) Prior Publication Data

US 2008/0237272 A1 Oct. 2, 2008

(30) Foreign Application Priority Data

Mar. 29, 2007 (FR) ..... 07 02321

(51) Int. Cl.
*B65D 35/38* (2006.01)

(52) U.S. Cl. ..... 222/494; 222/321.3; 222/321.7; 222/321.9; 222/380; 222/490

(58) Field of Classification Search ..... 222/494, 222/490, 491–492, 498, 321.7, 321.9, 209, 222/380, 383.1, 321.3, 385, 481.5; 239/333
See application file for complete search history.

(56) References Cited

U.S. PATENT DOCUMENTS

| | | | | |
|---|---|---|---|---|
| 3,602,407 | A | 8/1971 | Grothoff | |
| 4,314,658 | A | 2/1982 | Laauwe | |
| 4,830,284 | A | 5/1989 | Maerte | |
| 5,518,377 | A * | 5/1996 | Bougamont et al. | 417/446 |
| 5,617,978 | A * | 4/1997 | Geier | 222/402.13 |
| 5,687,884 | A * | 11/1997 | Bodin et al. | 222/321.7 |
| 5,819,990 | A * | 10/1998 | Cimentepe et al. | 222/207 |
| 7,481,336 | B2 * | 1/2009 | Arghyris et al. | 222/321.7 |
| 7,575,134 | B2 * | 8/2009 | Martin et al. | 222/494 |
| 7,654,419 | B2 * | 2/2010 | Dobbs et al. | 222/321.9 |
| 2007/0158365 | A1 | 7/2007 | Kim | |

FOREIGN PATENT DOCUMENTS

| | | | |
|---|---|---|---|
| EP | 0696480 | A1 | 2/1996 |
| FR | 2785878 | A1 | 5/2000 |
| JP | 10109060 | A | 4/1998 |

OTHER PUBLICATIONS

French Search Report, Nov. 22, 6 Pages.

* cited by examiner

*Primary Examiner* — Frederick C. Nicolas
(74) *Attorney, Agent, or Firm* — St. Onge Steward Johnston & Reens LLC

(57) ABSTRACT

A nozzle for dispensing a liquid contained in a receptacle, the nozzle including a rigid body provided with a dispensing channel including a dispensing orifice emerging in the front wall of the body, the nozzle also including an elastically deformable sleeve that is disposed in a non-adherent fashion and in clamping contact around at least part of the periphery of the rigid body, the sleeve being provided with at least one front lip that is disposed opposite the dispensing orifice, the lip being arranged so as, by application of the dispensing pressure of the liquid on it, to be reversibly movable between a stable closed state and stressed opening state of the orifice, in which the attachment of the sleeve on the rigid body is achieved in combination by a first attachment for retaining the axial movement of the rear part of the sleeve relative to the rigid body and by a second attachment for retaining the axial movement of another part of the sleeve relative to the rigid body.

20 Claims, 3 Drawing Sheets

DISPENSING NOZZLE COMPRISING AN AXIALLY ATTACHED CLOSURE SLEEVE

CROSS-REFERENCE TO RELATED APPLICATIONS

The present application claims priority of French patent application No. 07 02321 filed on Mar. 29, 2007, the content of which is incorporated herein by reference.

FIELD OF THE INVENTION

The invention concerns a nozzle for dispensing a liquid contained in a receptacle, as well as a dispensing pump comprising such a nozzle.

In a particular application, the liquid is of the gel or cream type, for example for use in cosmetics or for pharmaceutical treatments.

BACKGROUND OF THE INVENTION

In a known fashion, a dispensing nozzle comprises a rigid body in which a liquid dispensing channel is formed. In order to limit contact between the external air and the liquid stationary in the dispensing channel, in particular to avoid drying and/or degradation of said liquid over time, the process of equipping the nozzles with devices for reversible closure of the orifice downstream of the dispensing channel is known.

In particular, such devices can be formed from an elastically deformable sleeve on which there is formed a lip that can be moved by application of the dispensing pressure on it. Reversible closure can then be obtained by disposing the sleeve around the rigid body, with said lip in sealed contact with the downstream orifice, the movement of said lip opening said orifice.

However, so that the lip can be moved with respect to the rigid body, the sleeve must be disposed in a non-adhering fashion around the rigid body. Problems of seal between the sleeve and the rigid body, of mechanical strength of said sleeve on the body and of adjusting the contact pressure of the lip on the downstream orifice are then posed.

SUMMARY OF THE INVENTION

The aim of the invention is to resolve the problems of the prior art by proposing in particular a dispensing nozzle equipped with a sleeve for reversible closure of the dispensing orifice, said nozzle combining optimal seal and mechanical strength whilst allowing adjustment of the opening and closing pressure.

To this end, according to a first aspect, the invention proposes a nozzle for dispensing a liquid contained in a receptacle, said nozzle comprising a rigid body provided with a dispensing channel that is intended to be put in communication with the inside of the receptacle, said channel comprising a dispensing orifice emerging in the front wall of said body, said nozzle also comprising an elastically deformable sleeve that is disposed in a non-adhering fashion and in clamping contact around at least part of the periphery of the rigid body, said sleeve being provided with at least one front lip that is disposed opposite the dispensing orifice, said lip being arranged so as, by application of the dispensing pressure of the liquid on it, to be reversibly movable between a stable closed state and a stressed state of opening of said orifice, in which the attachment of said sleeve to said rigid body is achieved in combination by a first means of retaining the axial movement of the rear part of said sleeve relative to said rigid body and by a second means of retaining the axial movement of another part of said sleeve relative to said rigid body, said other part being disposed between the rear part and the front lip of said sleeve.

According to a second aspect, the invention proposes a pump intended to be mounted on a receptacle so as to allow the dispensing of a liquid in said receptacle, said pump comprising a dispensing path, the downstream end of which is provided with such a dispensing nozzle.

BRIEF DESCRIPTION OF THE DRAWINGS

Other objects and advantages of the invention will emerge in the following description given with reference to the accompanying figures in which.

DETAILED DESCRIPTION OF THE INVENTION

Figure 1:
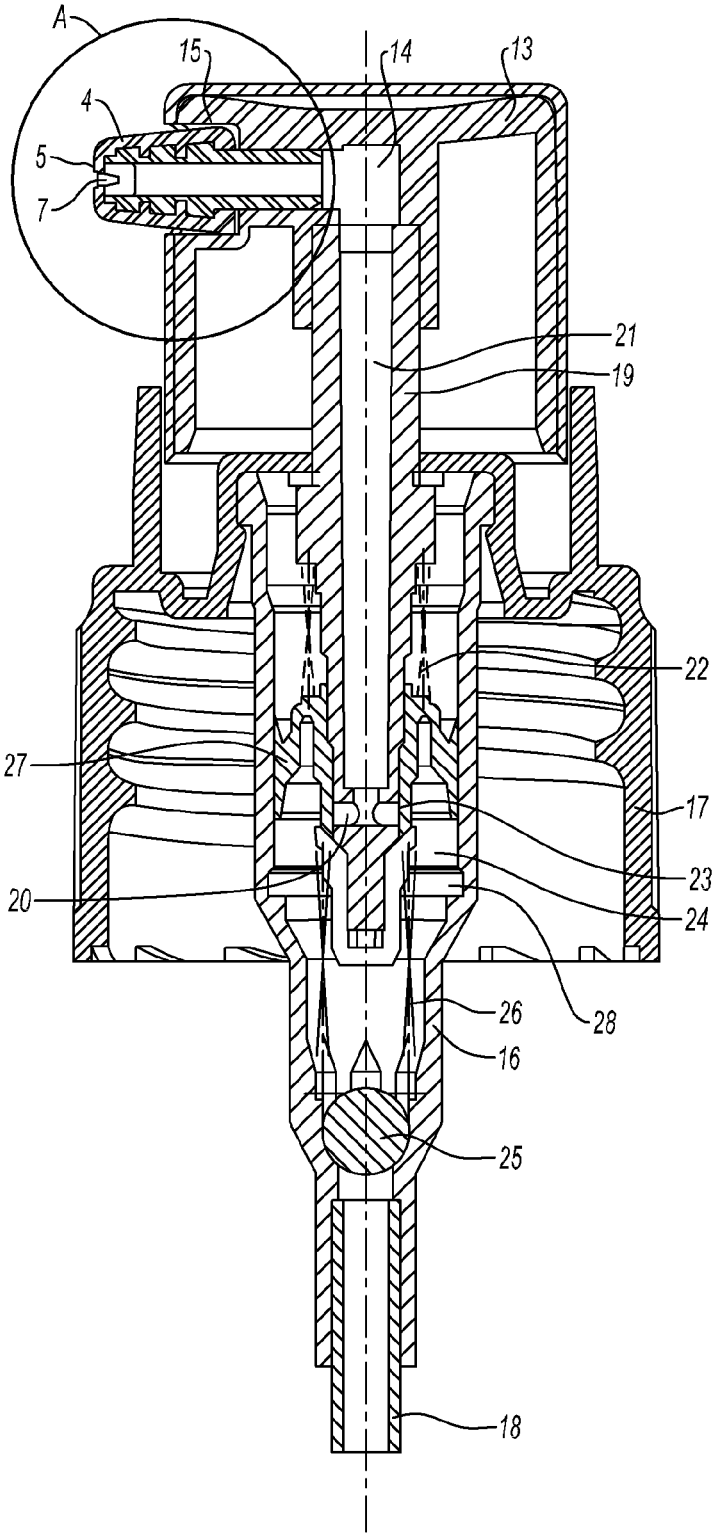
FIG. 1 is a partial view in longitudinal section of a pump comprising a dispensing nozzle according to one embodiment of the invention, in the idle position.

In the description, the terms of positioning in space are taken with reference to the position of the pump shown in FIG. 1.

In relation to the figures, an embodiment is described of a nozzle for dispensing a liquid contained in a receptacle (not shown). In an example application, the liquid is a gel or a cream for cosmetic use or for pharmaceutical treatments.

The nozzle comprises a rigid body 1 that is provided with a dispensing channel 2 intended to be put in communication with the inside of the receptacle, said channel comprising a dispensing orifice 3 emerging in the front wall of said body. In the figures, the body 1 and the orifice 3 have similar geometry, namely an oval cross section. In an example embodiment, the rigid body 1 is moulded, for example in PBT (polybutylene terephthalate) or a polymer of the PET (polyethylene terephthalate) family.

In the embodiment in FIG. 1, the dispensing is carried out by means of a pump on which the nozzle is mounted. However, the nozzle may find its application in other dispensing modes, for example by being mounted on a manually deformable receptacle to allow dispensing.

The nozzle also comprises an elastically deformable sleeve 4 that is provided with at least one front lip 5 disposed opposite the dispensing orifice 3. In an example embodiment, the sleeve 4 is produced from elastomeric polymer of the EPDM (ethylene propylene diene monomer), SEBS (styrene ethylene butylene styrene) or SBS (styrene butadiene styrene) type.

The lip 5 is arranged so as, by application of the dispensing pressure of the liquid on it, to be reversibly movable between a stable closed state (FIG. 2*a*) and a stressed open state (FIG. 2*b*) of said orifice. To allow this reversible movement of the lip 5, the sleeve 4 is disposed in a non-adherent fashion and in clamping contact around at least part of the periphery of the rigid body 1.

Figure 2A:
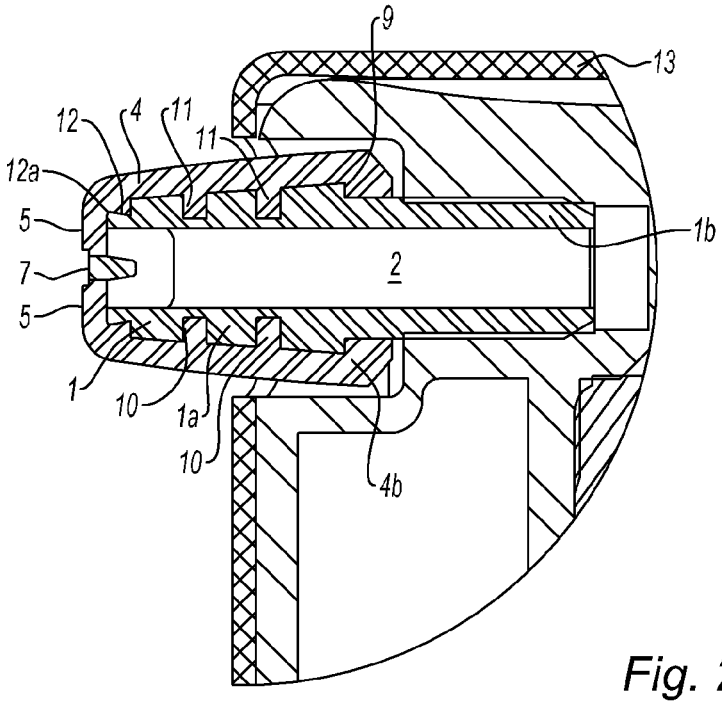
FIG. 2 are enlarged views of the circled part referenced A in FIG. 1, showing the lip of the sleeve respectively in the closed position (FIG. 2*a*) and in the open position (FIG. 2*b*)
Figure 2B:
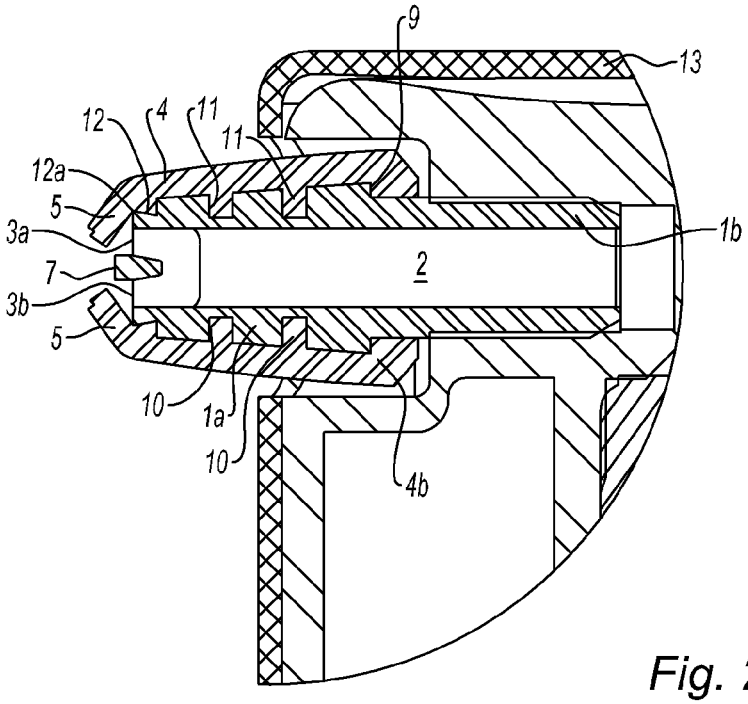
Figure 3:
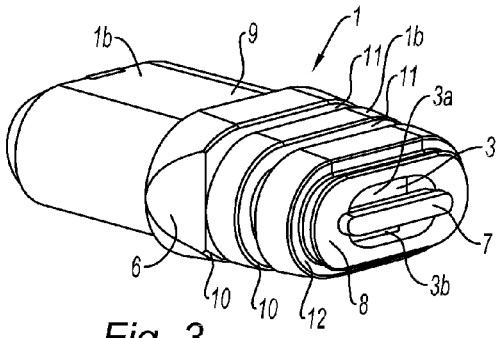
FIG. 3 is a view in perspective of the rigid body of the nozzle according to FIG. 1.
Figure 4:
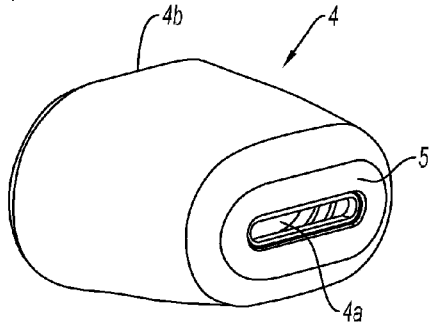
FIG. 4 is a perspective view of the elastically deformable sleeve of the nozzle according to FIG. 1.

Thus, when no dispensing force is applied to the lip 5, the latter is elastically pressed on the dispensing orifice 3 so as to block it and therefore to isolate the content of the channel 2 from the outside air (FIG. 2*a*). Next, by application of the dispensing pressure, the lip 5 deforms elastically to allow dispensing of the liquid through the orifice 3 (FIG. 2*b*). Finally, the cancellation of the dispensing pressure leads to an elastic return of the lip 5 to the closed position. In particular, this design makes it possible to limit, between two uses, the drying of the liquid, in particular of a cream, as well as any degradation and/or contamination of the liquid in the case of prolonged exposure to the outside air.

Figure 5A:
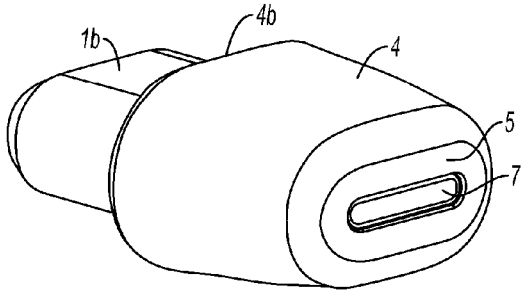
FIG. 5 are views of the nozzle according to FIG. 1, respectively in perspective (FIG. 5*a*) and in longitudinal section along the axis of the cross member (FIG. 5*b*).
Figure 5B:
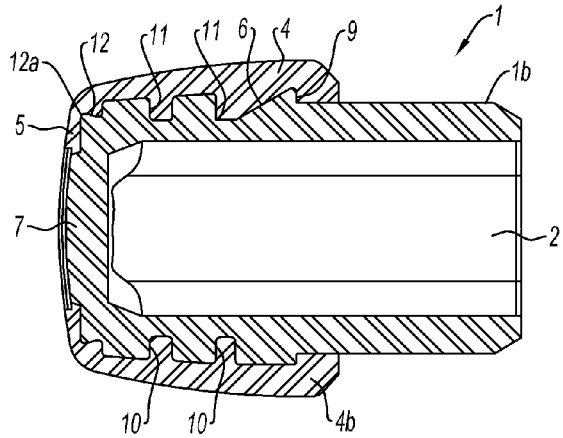

According to one embodiment, the sleeve 4 is moulded in a non-adherent fashion to the rigid body 1, which enables it to perfectly match the shapes thereof. In addition, by an appropriate choice of materials and/or operating conditions of the overmoulding, it is possible to benefit from the differential shrinkage between the moulded body 1 and the overmoulding of the sleeve 4, so as to increase the clamping force of said sleeve around said rigid body. Moreover, as shown in FIG. 5*b*, the periphery of the body 1 is provided with a bevel 6 that is formed in line with the overmoulding point of the sleeve 4, so as to facilitate the distribution of the material by forming a local protrusion in said sleeve.

In the embodiment shown, the dispensing orifice 3 has an insert that is centred axially so as to form liquid passages around it, the sleeve 4 comprising a radial lip 5 that surrounds said insert sealingly in its closed state. More precisely, the insert is formed by a cross member 7 extending along the major axis of the orifice, so as to form two passages 3*a*, 3*b* for two symmetrical layers, respectively top and bottom. This design improves the discharge of the liquid, in particular by forming a substantially axial liquid flow by bringing together the two layers.

The front face of the sleeve 4 comprises an orifice 4*a* in which the cross member 7 is disposed sealingly, and the radial lip 5 has an overall geometry that is formed around said orifice. In addition, the cross member 7 is provided in axial projection with respect to the orifice 3, and a planar surface 8 is formed all around the orifice 3. Thus, by providing a thickness of the cross member 7 similar to that of the sleeve 4, the aesthetic appearance of the end of the nozzle in the closed position can be improved by making it substantially flat.

In addition, in its closed state, the lip 5 is in sealed contact with the flat surface 8 and with the periphery of the cross member 7, which improves the seal. Moreover, in this embodiment, the lip 5 has a geometry similar to that of the periphery of the body 1, which contributes to good distribution of the forces exerted on said lip during its opening.

The attachment of the sleeve 4 on the rigid body 1 is achieved by a first means of retaining the axial movement of the rear part of said sleeve relative to said rigid body. In the embodiment shown, the first retaining means is produced by a rear radial surface 9 that is formed on the periphery of the rigid body 1. More precisely, the rear radial surface 9 is formed by a change in radial dimension of the periphery of the body 1, between a front zone 1*a* on which the sleeve 4 is disposed and a rear zone 1*b* without said sleeve. In the embodiment described, the front zone 1*a* has a radial dimension greater than that of the rear zone 1*b*. In addition, the rear zone 1*b* forms a rear association surface.

The rear part 4*b* of the sleeve 4 is then designed to be in axial abutment on the radial surface 9, in particular by providing for said rear part to come to cover said surface. To do this, the rear part 4*b* can encase the rigid body 1 on each side of the join between the front 1*a* and rear 1*b* zones.

However, other embodiments of the first retaining means can be envisaged, either by having different geometries or by welding or adhesively bonding the rear part of the sleeve 4 on the periphery of the rigid body 1.

The attachment of the sleeve 4 on the rigid body 1 is also achieved by a second means of retaining the axial movement of another part of said sleeve relative to said rigid body, said other part being disposed between the rear part 4*b* and the front lip 5 of said sleeve.

The combination of the first and second retaining means makes it possible in particular to limit the axial movement of the sleeve 4 relative to the body 1, by elastic deformation thereof. Thus, the seal between the body 1 and the sleeve 4 is improved, in particular at the lip 5. In addition, the strength of the attachment is also improved in relation to the external mechanical stresses that the nozzle undergoes in the context of its use, but also in relation to the forces exerted on the sleeve 4 during the dispensing of the liquid. In addition, the adjustment of the sealing force exerted by the lip 5 on the orifice 3 becomes easier in that the deformation of the sleeve 4 is more localised, in particular by being substantially limited at the lip 5.

In the embodiment depicted, a second retaining means is produced by a rear radial surface 10 that is formed on the periphery of the rigid body 1, the sleeve 4 being in axial abutment on said radial surface. In particular, the radial surface 10 is produced in a recess 11 formed on the periphery of the rigid body 1, the sleeve 4 filling said recess. On the figures, the periphery of the rigid body 1 has two recesses 11 of revolution that are spaced axially so as to form two radial surfaces 10 extending over the circumference of the periphery of the rigid body 1.

According to embodiments not shown, the second retaining means can have a different geometry or be produced by welding or adhesive bonding of an intermediate part of the sleeve 4 on the periphery of the rigid body 1.

In relation to the figures, a second embodiment of a second retaining means is described, which is formed by a bevel 12 produced on the edge of the front wall of the rigid body 1. As shown, the bevel 12 can be provided in combination with recesses 11 described below, or only one of the two embodiments described can be used as a second retaining means.

The bevel 12 is produced by a recess formed on the periphery of the rigid body 1, the front surface of the said recess extending as far as the front edge of the rigid body 1 at a divergent angle. In this way there is formed, on the front end of the bevel 12, a line 12*a* for rotation of the lip 5 with respect to the rigid body 1. In this embodiment, the opening of the lip 5 limits the deformation of the sleeve 4 to a simple rotation of said lip, which allows good control of the sealing forces exerted by the lip 5, as well as the forces necessary for opening the dispensing orifice 3.

In addition, the divergence of the bevel 12 improves the seal between the sleeve 4 and the body 1 by preventing the introduction of liquid between them, in particular when the lip 5 is closed.

Moreover, in the case of overmoulding with differential shrinkage between the sleeve 4 and the body 1, the presence of the bevel 12 makes it possible to limit a possible detachment of the lip 5 on the orifice 3 by axial shrinking of said sleeve.

By way of example, a contact pressure of the lip 5 on the downstream orifice 3 of around 200 to 500 mbar is acceptable to form impermeability to air whilst keeping the possibility of opening said lip by application of the dispensing pressure. This pressure can be obtained by using a sleeve 4 the material of which has a Shore A hardness of around 35. However, the use of materials whose Shore A hardness is between 15 and 80 makes it possible to adjust the opening/closing pressure of the lip 5 according to the specific sealing requirements and/or the compression capacity of the pump and/or the viscosity of the liquid to be dispensed.

Advantageously, the nozzle can be used with a pump intended to be mounted on a receptacle so as to allow the dispensing of a liquid contained in said receptacle. The pump then comprises a dispensing path the downstream end of which is provided with a nozzle to allow the dispensing of liquid through it.

According to an embodiment not shown, the pump comprises a push button of which the nozzle forms an integral part.

According to the embodiment shown, the pump comprises a push button 13 provided with a channel 14 forming the downstream part of the dispensing path, the nozzle being associated with the inside of the downstream end of the said channel.

The push button 13 comprises a front housing 15 in which the channel 14 emerges, said housing being arranged to receive without interference at least part of the sleeve 4, in this case the rear part of the sleeve 4 since the nozzle is provided projecting from said push button. In addition, the rear association surface 1*b* is fitted in the channel 14, which emerges at the rear of the housing 15, this fitting being achieved without interposition of the sleeve 4 so as to improve its reliability.

During the priming phase of the pump, the presence of the sleeve 4 can limit the air exhaust capacity through the distribution path. This is because the pressure of the air compressed by the pump may not be sufficient to cause the opening of the dispensing orifice 3 and therefore the discharge of the air by means of the nozzle. In addition, the distribution path can comprise a valve between the pump and the content of the receptacle, the seal on which may be inferior to that conferred by the sleeve 4. Moreover, in the case of a liquid with a high viscosity and/or density, the problems of priming are all the more critical.

According to a first aspect, these problems can be surmounted by adjusting the opening and closing pressure of the lip 5 so that is strictly less that the sealing pressure of the valve, said opening and closing pressure also being less than the minimum compression pressure of the air in the pump in particular during the priming phase.

To surmount these problems according to a second aspect, the pump can comprise an air escape path that is distinct from the dispensing path, said escape path being arranged to allow a discharge of the air compressed by said pump.

Principally the pump shown comprises a pump body 16 intended to be secured to the receptacle while being able to be put in communication with the liquid, for example by means of a threaded association cup 17. In addition, the pump comprises a plunger tube 18 secured to the body 16. However, other means of supplying the pump are known, for example pumps without air recovery.

The pump also comprises a jet 19 secured to the push button 13 so as to be actuated in translation in said body, said jet comprising at least one upstream orifice 20 and a channel 21, the downstream end of which is in communication with the dispensing nozzle. A means 26 for the elastic return of the translation of said jet in said body is also provided.

The pump also comprises a piston 23 mounted in rubbing contact against the internal surface of said body so as to delimit an apportioning chamber 24 that is intended to be in communication with the liquid by means of a valve, formed by a ball 25 in FIG. 1. The piston 23 is moved in translation by the jet 19 over a compression travel of the apportioning chamber 24, said piston being arranged so as to close the upstream orifices 20 on the descending compression travel and ascending suction travel and, on a descending dispensing travel of said jet, to enable the upstream orifices 20 to be put in communication with the apportioning chamber 24. The piston 23 is mounted around the jet 19 in a sliding fashion, said sliding being able to be constrained by an elastic return means 22.

The internal surface of the body includes air escape means that are arranged so as, in a part of the compression travel, to break the rubbing contact of the piston 23 on said surface so as to allow a leakage of air from the apportioning chamber 24 towards the outside of the body 16.

According to one embodiment, the air escape means are formed to break the rubbing contact of a sealing lip 27 of the piston 23 on the internal surface of the body 16 so as to allow a leakage of air from the apportioning chamber 24 towards the outside of the body 16. Thus the air compressed during the priming phase is not discharged through the dispensing path but directly to the outside of the pump. The result is an increase in the suction force on the liquid when the jet 19 rises, and therefore an optimisation of the priming phase.

In FIG. 1, the escape means are formed by a zone 28 with a larger diameter than the nominal diameter of the internal surface of the body 16, said zone being provided at the join between the compression and dispensing travels. Thus, when the sealing lip 27 passes over the zone 28 of greater diameter, it detaches from the internal surface of the body 16 so as to break the seal at one point. In a variant, the escape means can be formed by protrusions and orifices provided on the internal surface of the body 16.

What is claimed is:

1. A nozzle for dispensing a liquid contained in a receptacle, said nozzle comprising a rigid body provided with a dispensing channel that is intended to be put in communication with an inside of the receptacle, said channel comprising a dispensing orifice emerging in a front wall of said rigid body, said nozzle also comprising an elastically deformable sleeve that is disposed in a non-adhering fashion and in clamping contact around at least part of a periphery of said rigid body, said sleeve being provided with at least one front lip that is disposed opposite the dispensing orifice, said lip being arranged so as, by application of dispensing pressure of the liquid on said lip, to be reversibly movable between a stable closed state and a stressed state of opening of said orifice, said nozzle being characterised in that an attachment of said sleeve to said rigid body is achieved in combination by a first means of retaining axial movement of a rear part of said sleeve relative to said rigid body and by a second means of retaining axial movement of another part of said sleeve relative to said rigid body, said other part being disposed between the rear part and the front lip of said sleeve, characterised in that a downstream orifice has an insert centered axially so as to form liquid passages around the insert, the sleeve comprising a radial lip that surrounds said insert sealingly in a closed state.

2. The dispensing nozzle according to claim 1, characterised in that the first retaining means is formed by a rear radial surface that is formed on the periphery of the rigid body, the rear part of the sleeve being in axial abutment on said radial surface.

3. The dispensing nozzle according to claim 1, characterised in that the second retaining means is formed by a rear radial surface that is formed on the periphery of the rigid body, the sleeve being in axial abutment on said radial surface.

4. The dispensing nozzle according to claim 3, characterised in that the periphery of the rigid body has two recesses that are spaced apart axially so as to form two radial surfaces, the sleeve filling said recesses.

5. The dispensing nozzle according to claim 1, characterised in that the rigid body comprises a rear association surface, said surface having no sleeve.

6. The dispensing nozzle according to claim 1, characterised in that the sleeve is moulded in a non-adherent fashion onto the rigid body.

7. A pump intended to be mounted on a receptacle so as to allow the dispensing of the liquid contained in said receptacle, said pump comprising a dispensing path, a downstream end of which is provided with the dispensing nozzle according to claim 1.

8. The pump according to claim 7, further comprising a push button provided with a channel forming the downstream part of the dispensing path, the dispensing nozzle being associated with the inside of the downstream end of said channel.

9. The pump according to claim 8, characterised in that the push button comprises a front housing in which the channel emerges, said housing being arranged so as to receive at least part of the sleeve without interference.

10. The pump according to claim 7, characterised in that the opening and closing pressure of the lip is strictly less that the sealing pressure of a valve provided in the dispensing path between the pump and the content of the receptacle, said opening and closing pressure also being less than a minimum compression pressure of the air in the pump.

11. A nozzle for dispensing a liquid contained in a receptacle, said nozzle comprising a rigid body provided with a dispensing channel that is intended to be put in communication with an inside of the receptacle, said channel comprising a dispensing orifice emerging in a front wall of said rigid body, said nozzle also comprising an elastically deformable sleeve that is disposed in a non-adhering fashion and in clamping contact around at least part of a periphery of said rigid body, said sleeve being provided with at least one front lip that is disposed opposite the dispensing orifice, said lip being arranged so as, by application of dispensing pressure of the liquid on said lip, to be reversibly movable between a stable closed state and a stressed state of opening of said orifice, said nozzle being characterised in that an attachment of said sleeve to said rigid body is achieved in combination by a first means of retaining axial movement of a rear part of said sleeve relative to said rigid body and by a second means of retaining axial movement of another part of said sleeve relative to said rigid body, said other part being disposed between the rear part and the front lip of said sleeve, characterised in that the second retaining means is formed by a bevel produced on an edge of the front wall of the rigid body.

12. The dispensing nozzle according to claim 11, characterised in that the bevel is produced by a recess formed on the periphery of the rigid body, the front surface of said recess extending as far as a front edge of the rigid body at a divergent angle.

13. The dispensing nozzle according to claim 11, characterised in that the first retaining means is formed by a rear radial surface that is formed on the periphery of the rigid body, the rear part of the sleeve being in axial abutment on said radial surface.

14. The dispensing nozzle according to claim 11, characterised in that the rigid body comprises a rear association surface, said surface having no sleeve.

15. The dispensing nozzle according to claim 11, characterised in that the sleeve is moulded in a non-adherent fashion onto the rigid body.

16. A pump intended to be mounted on a receptacle so as to allow the dispensing of a liquid contained in said receptacle, said pump comprising:

a dispensing path, a downstream end of which is provided with a dispensing nozzle; and an air escape path that is distinct from the dispensing path, said escape path being arranged so as to allow a discharge of the air compressed by said pump;

wherein the nozzle comprises a rigid body provided with a dispensing channel that is intended to be put in communication with an inside of the receptacle, said channel comprising a dispensing orifice emerging in a front wall of said rigid body, said nozzle also comprising an elastically deformable sleeve that is disposed in a non-adhering fashion and in clamping contact around at least part of a periphery of said rigid body, said sleeve being provided with at least one front lip that is disposed opposite the dispensing orifice, said lip being arranged so as, by application of dispensing pressure of the liquid on said lip, to be reversibly movable between a stable closed state and a stressed state of opening of said orifice, said nozzle being characterized in that an attachment of said sleeve to said rigid body is achieved in combination by a first means of retaining axial movement of a rear part of said sleeve relative to said rigid body and by a second means of retaining axial movement of another part of said sleeve relative to said rigid body, said other part being disposed between the rear part and the front lip of said sleeve.

17. The pump according to claim 16, further comprising:

a pump body intended to be secured to the receptacle while being able to be put in communication with the liquid;

a jet secured to the push button so as to be actuated in translation in said body, said jet comprising at least one upstream orifice and a channel, the downstream end of which is in communication with the dispensing nozzle;

a means for the elastic return of the translation of said jet in said body;

a piston mounted in rubbing contact against an internal surface of said body so as to delimit an apportioning chamber that is intended to be in communication with the liquid by means of a valve, said piston being moved in translation by the jet on a compression travel of the apportioning chamber, said piston being arranged so as to close the at least one upstream orifice on the descending compression and ascending suction travel and, on a descending dispensing travel of said jet, to enable the upstream orifices to be put in communication with the apportioning chamber;

in which the internal surface of the body includes air escape means that are arranged so as, in a part of the compression travel, to break the rubbing contact of the piston on said surface so as to allow a leakage of air from the apportioning chamber to the outside of the body.

18. The pump according to claim 16, further comprising a push button provided with a channel forming the downstream part of the dispensing path, the dispensing nozzle being associated with the inside of the downstream end of said channel.

19. The pump according to claim 18, characterised in that the push button comprises a front housing in which the channel emerges, said housing being arranged so as to receive at least part of the sleeve without interference.

20. The pump according to claim 16, characterised in that the opening and closing pressure of the lip is strictly less that a sealing pressure of a valve provided in the dispensing path between the pump and a content of the receptacle, said opening and closing pressure also being less than a minimum compression pressure of the air in the pump.

* * * * *